US010519753B2

(12) United States Patent
Dedman et al.

(10) Patent No.: US 10,519,753 B2
(45) Date of Patent: Dec. 31, 2019

(54) APPARATUS AND METHOD FOR RUNNING CASING IN A WELLBORE

(71) Applicant: KLX Inc., Wellington, FL (US)

(72) Inventors: Michael R. Dedman, Edgar, MT (US); Scott Earl Williamson, Castle Rock, CO (US)

(73) Assignee: KLX Energy Services, LLC, Houston, TX (US)

( * ) Notice: Subject to any disclaimer, the term of this patent is extended or adjusted under 35 U.S.C. 154(b) by 124 days.

(21) Appl. No.: 15/712,399

(22) Filed: Sep. 22, 2017

(65) Prior Publication Data

US 2018/0080308 A1 Mar. 22, 2018

Related U.S. Application Data

(60) Provisional application No. 62/398,198, filed on Sep. 22, 2016.

(51) Int. Cl.

| | |
|---|---|
| ***E21B 43/10*** | (2006.01) |
| ***E21B 21/10*** | (2006.01) |
| ***E21B 34/06*** | (2006.01) |
| ***E21B 34/14*** | (2006.01) |

(52) U.S. Cl.

CPC ..... *E21B 43/10* (2013.01); *E21B 21/10* (2013.01); *E21B 34/063* (2013.01); *E21B 34/14* (2013.01)

(58) Field of Classification Search

CPC ..... E21B 43/10; E21B 21/10; E21B 34/14; E21B 34/063; E21B 33/12; E21B 33/126; E21B 33/14; E21B 33/1208; E21B 33/134; E21B 37/04; E21B 37/10

See application file for complete search history.

(56) References Cited

U.S. PATENT DOCUMENTS

| | | | | |
|---|---|---|---|---|
| 5,117,915 | A * | 6/1992 | Mueller | E21B 7/04 166/381 |
| 6,334,488 | B1 | 1/2002 | Freiheit | |
| 2014/0216756 | A1 | 8/2014 | Getzlaf et al. | |
| 2014/0338923 | A1* | 11/2014 | Fripp | E21B 34/063 166/376 |
| 2016/0333658 | A1* | 11/2016 | Keshishian | E21B 33/16 |

OTHER PUBLICATIONS

Canadian Patent Office, Requisitton by the Examiner dated Oct. 22, 2018.

* cited by examiner

*Primary Examiner* — George S Gray

(74) *Attorney, Agent, or Firm* — Duane Morris LLP

(57) ABSTRACT

A float collar tool for running a casing string assembly into a wellbore includes a non-fragmenting rupture disc that temporarily isolates light fluid trapped in a lower portion of the casing string from heavier fluid in the upper portion of the casing string, thereby reducing the horizontal weight of the casing string by an amount sufficient to overcome a drag force. After the casing string is landed at a final location in the wellbore, the rupture disc is burst by increasing fluid pressure in the upper portion of the casing string. The increased pressure activates a piston that then moves the burst rupture disc into a protective region of the tool so that the inside diameter of the casing string is substantially restored.

16 Claims, 3 Drawing Sheets

APPARATUS AND METHOD FOR RUNNING CASING IN A WELLBORE

CROSS-REFERENCE TO RELATED APPLICATIONS

This application claims the benefit of U.S. Provisional Patent Application No. 62/398,198, entitled "Floatation Collar for Use in Floating Casing to Depth by Reducing Casing Drag," filed on Sep. 22, 2016, which is hereby expressly incorporated herein by, reference in its entirety.

FIELD OF THE DISCLOSURE

The present disclosure relates generally to downhole equipment for hydrocarbon wells. More particularly, the present disclosure pertains to a method and apparatus for floating casing to depth in a wellbore.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, a casing is then lowered and set in place.

In many wells, it can be difficult to run the casing to great depths because friction between the casing and the wellbore during run-in often results in a substantial amount of drag. This is particularly true in horizontal and/or deviated wells, where, in some cases, the drag on the casing can exceed the available weight of the casing in the vertical section of the wellbore that would otherwise tend to progress the casing further along. If there is insufficient weight in the vertical portion of the wellbore, it can be difficult or impossible to overcome the drag in the wellbore, thus limiting the depth to which the casing can be run or preventing completion of a horizontal or deviated well.

SUMMARY

The following introduces a selection of concepts in a simplified form in order to provide a foundational understanding of some aspects of the present disclosure. The following is not an extensive overview of the disclosure, and is not intended to identify key or critical elements of the disclosure or to delineate the scope of the disclosure. The following merely presents some of the concepts of the disclosure as a prelude to the more detailed description provided thereafter.

According to an embodiment, a tool for running a casing string in a wellbore is disclosed. The tool includes a cylindrical housing having an inside diameter that defines a fluid passageway extending between first and second ends of the housing, the first and second ends configured to connect the housing within a casing string. The tool also includes an isolation barrier disposed within the cylindrical housing and having closed and open second states, wherein, in the closed state, the isolation barrier seals the inside diameter to fluidly isolate an upper portion of the passageway from a lower portion of the passageway, and wherein, in the open state, the isolation barrier allows for fluid communication through the fluid passageway. A protective region is formed in the cylindrical housing to contain the isolation barrier when in the open state so that the isolation barrier does not restrict the inside diameter.

According to another embodiment a method for running a casing string assembly into a wellbore includes connecting a float collar tool within the casing string assembly. The float collar tool comprises a cylindrical housing having a fluid passageway extending between an upper end and a lower end, an isolation barrier temporarily disposed across a diameter of the fluid passageway to create a buoyancy chamber in which a light fluid is trapped in a lower portion of the casing string assembly; and a protective region formed in the cylindrical housing to store the isolation barrier after the casing string is landed at a final location in the wellbore. The method further includes providing a fluid in an upper portion of the casing string assembly that is heavier than the light fluid trapped in the lower portion of the casing string assembly, landing the casing string assembly at the final location in the borehole, and then increasing fluid pressure in the upper portion of the casing string assembly to disrupt the isolation barrier and provide fluid communication between the upper and lower portions. The disrupted isolation barrier is then moved into the protective region to restore the diameter of the fluid passageway.

In another embodiment, a casing string assembly for completing a wellbore includes a lower casing string portion, an upper casing string portion, and a float collar tool connected between the lower and upper casing string portions. The float collar tool includes a cylindrical housing having a fluid passageway that extends between an upper end and a lower end of the housing, wherein the upper end of the housing is connected to the upper casing string portion and the lower end of the housing is connected to the lower casing string portion. The tool further includes a barrier disposed within the fluid passageway during run-in of the casing string assembly in the wellbore, and a protective region formed within the cylindrical housing to store the barrier after landing the casing string assembly at a final location in the wellbore. The assembly also has a sealed buoyancy chamber that contains a light fluid and that extends between the barrier and a sealing device disposed in the lower casing string portion. During run-in of the casing string assembly in the wellbore, the barrier isolates the light fluid in the buoyancy chamber from a heavier fluid in the upper casing string portion.

BRIEF DESCRIPTION OF THE DRAWINGS

Certain embodiments of the invention are described with reference to the accompanying drawings, wherein like reference numerals denote like elements. It should be understood, however, that the accompanying drawings illustrate only the various implementations described herein and are not meant to limit the scope of various technologies described herein. Various embodiments of the current invention are shown and described in the accompanying drawings of which.

Figure 1:
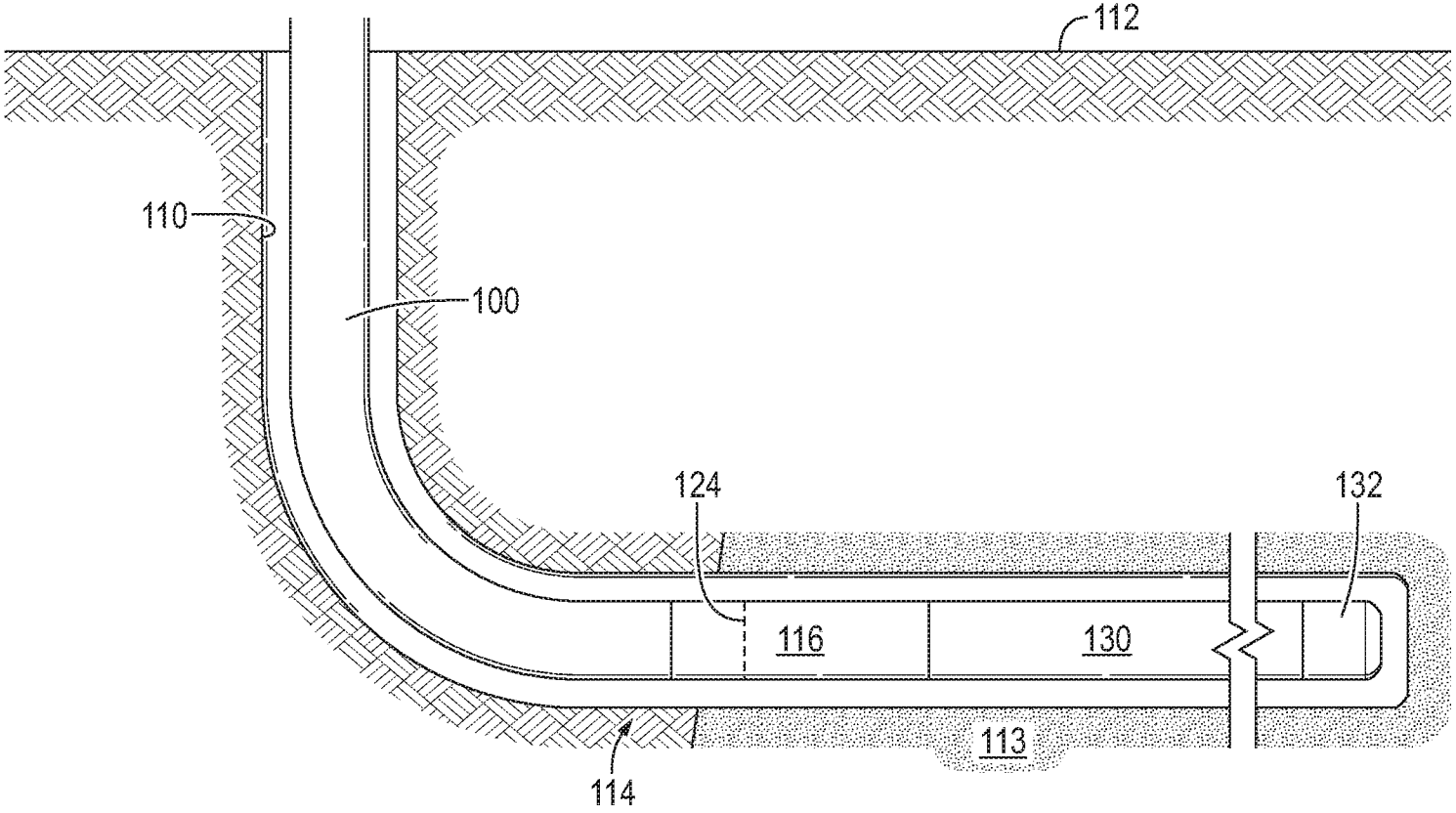
FIG. 1 schematically illustrates a casing string assembly, including a float collar tool, being run into a non-vertical wellbore, according to an embodiment.

Embodiments of the present disclosure and their advantages are best understood by referring to the detailed description that follows. It should be appreciated that like reference numbers are used to identify like elements illustrated in one or more of the figures, wherein showings therein are for purposes of illustrating embodiments of the present disclosure and not for purposes of limiting the same.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

Certain terms are used throughout the following description to refer to, particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion, the terms "including" and "comprising" are used in an open-ended fashion, and thus should be interpreted to mean "including, but not limited to." Also, the term "couple" or "couples" is intended to mean either an indirect or direct connection. Thus, if a first device couples to a second device, that connection may be through a direct connection, or through an indirect connection via other devices, components, and connections. Any reference to up or down in the description is made for purposes of clarity, with "up", "upper," "upwardly", or "upstream" meaning toward the surface of the borehole and with "down", "lower", "downwardly", "downhole", or "downstream" meaning toward the terminal end of the borehole, regardless of the borehole orientation.

Systems and techniques for lowering a casing or a liner (either referred to herein as casing) to a desired depth or location in a borehole that penetrates a hydrocarbon reservoir are well known. However, because friction between the casing and the borehole can create drag, running the casing to great depths or over extended horizontal distances can be challenging. In boreholes that are non-vertical, such as horizontal or deviated wellbores, the drag can present a large obstacle to completing the well. Various techniques have been developed to overcome this drag so that greater vertical well depths and horizontal wells can be achieved. For instance, techniques to lighten or "float" the casing have been used to extend the depth of or to complete the well. For example, techniques are known in which the ends of a casing string portion are plugged and are filled with a low density, miscible fluid to provide a buoyant force. However, after the plugged portion is placed in the wellbore, the plug must be drilled out, and the low density miscible fluid is forced out into the wellbore.

According to other known techniques for floating casing, a rupture disc assembly is provided where, after the casing is installed in the wellbore, the rupture disc can be ruptured by engagement with an impact surface of a tube. However, engagement with the impact surface shatters the disc, resulting in shattered disc fragments that remain in the wellbore. These fragments can damage the casing string or tools lowered within the string as fluid circulates within the wellbore. Moreover, the inside diameter of the casing may be restricted following the rupture of the disc, which can later prevent or impede conveyance of downhole tools within the restricted region of the casing string so that further operations, such as cementing, cannot be readily performed using conventional techniques.

Embodiments disclosed herein are directed to devices and methods to float a casing string in a wellbore in order to extend the depth or horizontal distance and that, when employed, do not introduce damaging debris or unduly restrict the inside diameter of the casing.

Referring now to FIG. 1, casing string assembly 100 that is being deployed in a wellbore 110 is schematically shown. The wellbore 110 has been drilled through an earth surface 112 and penetrates a region of interest 113 (e.g., a hydrocarbon reservoir). As shown, the wellbore 110 includes a horizontal or deviated section 114. Within the section 114, the casing string assembly 100 includes a float collar tool 116 to assist with running the casing string assembly 100 to the desired location or depth in the wellbore 100. As will be described in further detail below, during run-in of the casing string 100, the float collar tool 116 is in a closed state in which fluid communication between upper and lower sections of the tool 116 is blocked. Once the string 100 is landed at a final desired location in the wellbore 110, the float collar tool 116 is transitioned to an open state in which fluid communication between the upper and lower sections is allowed.

The casing string assembly 100 also includes a fluid blocking device 132 located in a lower portion of the casing string 100, such as at or near the terminal end of the string 100. In embodiments, the blocking device 132 can be located one or more thousands of feet from the float collar tool 116. The blocking device 132 prevents drilling fluids or other wellbore fluids from entering the casing string assembly 100 as it is being run into the wellbore 100. As such, when the float collar tool 116 is added to the string 100 and is in its closed state, the blocking device 132 and collar 116 operate in conjunction to form a buoyant chamber 130 in the lower portion of the casing string assembly 100 in which a light fluid (e.g. air, gas or other lightweight fluid) is trapped, as will be further described below. In embodiments, the blocking device 132 can be a temporary plug that is removed after the casing 100 is positioned at the desired final location. Or, the device 132 can be a one-way float valve that prevents fluid from entering the casing string 100, but allows fluid to be pumped through the string 100 during circulation and/or cementing after the collar 116 has been converted to its open state.

Figure 2:
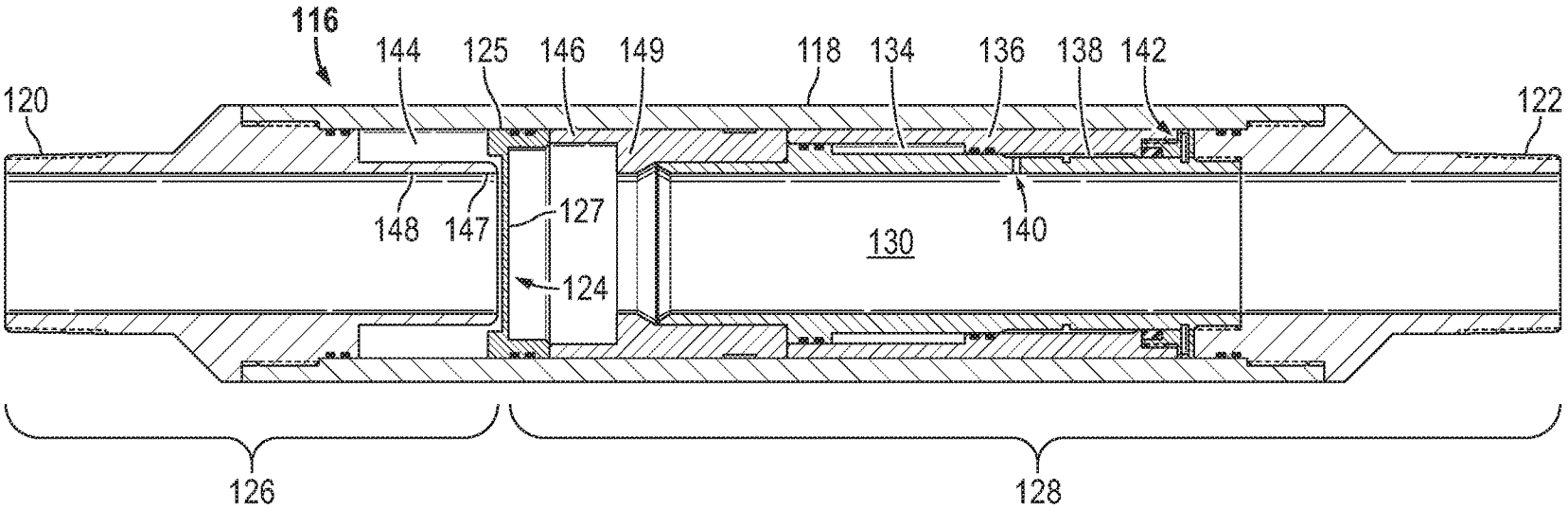
FIG. 2 is a cross-sectional view of a float collar tool when in a closed state, according to an embodiment.

FIG. 2 shows a cross-sectional view of the float collar tool 116 that, in FIG. 1, is positioned in the non-vertical portion 114 of the wellbore 110. Float collar 116 includes a cylindrical housing 118 defining an internal fluid passageway that extends between first and second ends 120, 122. Ends 120 and 122 are configured so that the tool 116 can be connected within the casing string assembly 100, such as by a threaded connection. For ease of reference, end 120 will be referred to as the "upper" end and end 122 will be referred to as the "lower" end. In this context, when the float collar 116 is assembled within the casing string 100 and run into in the wellbore 110 the upper end 120 is the end closest to the surface 112 and the lower end 122 is the end closer to the terminal end of the wellbore 110.

Figure 3:
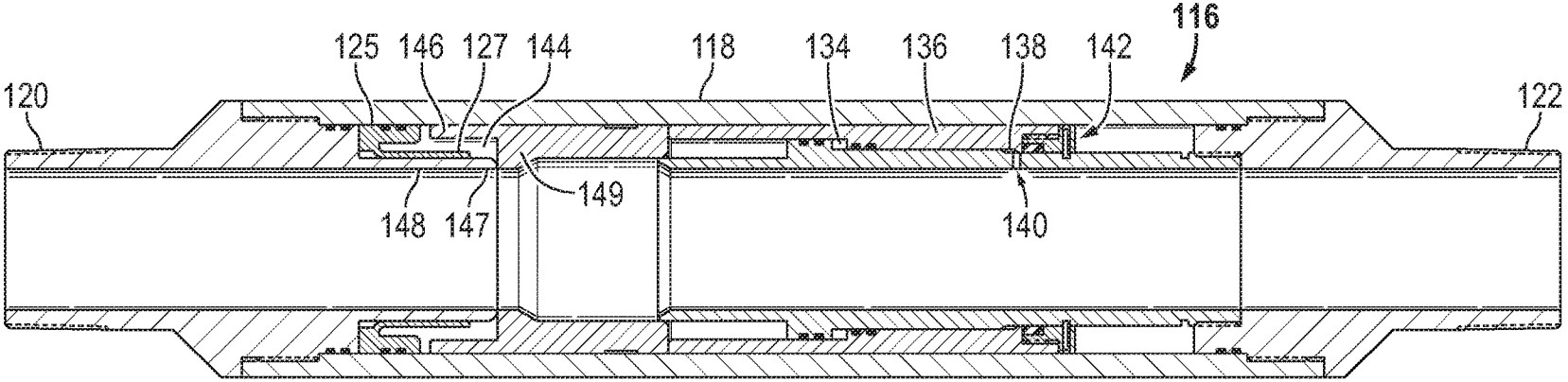
FIG. 3 is a cross-sectional view of the float collar tool of FIG. 2 when in an open state, according to an embodiment.

Float collar 116 can be converted between an initial closed state (shown in FIG. 2) and a final open state (shown in FIG. 3). In the closed state, an isolation barrier 124 temporarily provides for fluid isolation between an upper section 126 and a lower section 128 of the internal passageway of the tool 116. In the embodiment shown, the isolation barrier 124 includes a cylindrical wall 125 enclosed at one end by a rupture disc 127. To convert the float collar tool 116 to the open state, rupture disc 127 can be ruptured by the application of fluid pressure applied from equipment at the surface 112, thus providing for fluid communication between passageway sections 126 and 128. In an embodiment, the rupture disc 127 is a non-fragmenting disc so that, when ruptured, the disc 127 does not shatter into fragments that later can restrict the inside diameter of the tool 116 or present sharp edges or shards that can damage equipment or tools that later are run through the casing string 100. In other embodiments, the barrier 124 can be any type of fluid isolation device that can be transitioned between closed and open states, such as a flapper valve as one example.

According to an embodiment, the float collar 116 is connected within the casing string 100 so as to maximize vertical weight on the casing string 100, while minimizing horizontal weight. To that end, in an embodiment, the isolation barrier 124 traps air and/or other low weight fluid in the lower tool portion 128 (and lower portion of the casing string 100) and isolates the lower portion 128 from heavier fluid in the upper portion 126 of the tool 116 (and the upper portion of the casing string 100 and wellbore 110). In operation, when the tool 116 is in the closed state, the isolation barrier 124 isolates the upper portion 126 of the fluid passageway (which is filled with a heavier fluid) from the buoyant chamber 130 in the passageway that extends between the barrier 124 and the fluid blocking device 132 (which contains a lighter weight fluid). As an example, heavier fluid in the upper portion 126 can be drilling mud, and the lighter weight fluid in the buoyant chamber 132 can be air, nitrogen, carbon dioxide, oil and/or other lightweight or miscible fluid. As will be appreciated by persons skilled in the art, this configuration reduces weight of the casing string 100 and consequently the drag and frictional force acting on the casing string 100 in accordance with Archimedes' Principle.

As further illustrated in FIGS. 2 and 3, the housing 118 is configured to define a protective region 144 to hold the isolation barrier 124 after the tool 116 has been placed in the open state (e.g., after disc 127 has been ruptured). The barrier 124 can be moved into the protective region 144 by mechanical, pressure-activated, or hydraulic means. As an example, the tool 116 can include a spring or other resilient member that pushes or slides the isolation barrier 124 into the protective region 144 after the disc 127 has been ruptured. As another example, and as shown in FIGS. 2 and 3, the lower section 128 of the tool 116 can include a pressure-activated slidable member 136 (e.g., a sleeve or piston) that is activated by a pressure differential between a first chamber 134 (e.g., an atmospheric chamber) and a second chamber 138 (e.g., a pressurized fluid chamber). To that end, when the tool 116 is in the open state, pressurized fluid is introduced into the buoyant chamber 130. A fluid port 140 provides a fluid path between the buoyant chamber 130 and the second chamber 138 to create the pressure differential that activates the piston 136. In an embodiment, the tool 116 further includes a locking assembly 142, such as a locking ring that interacts with a locking feature formed in the housing 118, to lock the piston 136 in place after it is activated.

Figure 4:
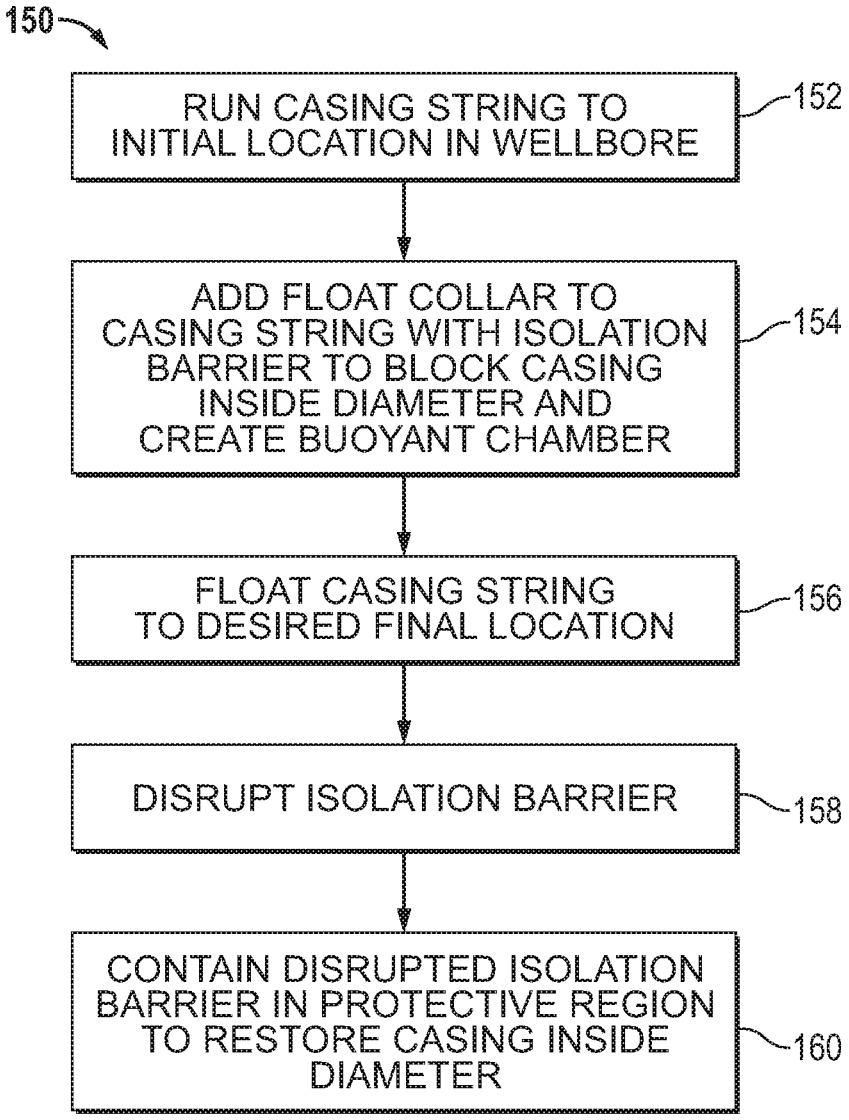
FIG. 4 is a flow diagram of n exemplary technique for running a casing string assembly that includes a float collar tool into a wellbore, according to an embodiment The headings provided herein are for convenience only and do not necessarily affect the scope or meaning of what is claimed in the present disclosure.

The installation of the casing string assembly 100 into a wellbore 110 and the operation of the tool 116 will next be described with reference to FIGS. 1-3 and flowchart 150 of FIG. 4. In operation, the float collar tool 116 can be used to install casing string assembly 100 in the wellbore 110. As discussed above, running a casing for long distances in a wellbore, particularly in wellbores that have a horizontal or deviated section, can result in significantly increased drag forces so that the casing can become stuck before reaching the desired final location. This is especially true when the horizontal weight of the casing string in the wellbore produces a greater drag force than the vertical weight that tends to move or slide the casing downwardly in the borehole. The amount of additional force that can be applied to the casing string to move it further into the wellbore is limited. That is, when too much force is applied to push the casing string into the well, the casing string can be damaged. The float collar tool 116 alleviates these problems.

In an embodiment, the casing string 100 is run into the wellbore 110 for a desired initial distance (block 152) using a conventional technique. The fluid blocking device 132 at the end of the string 100 prevents fluids in the wellbore 110 from entering the casing 100. Once the desired initial distance is reached, the float collar tool 116 is added to the casing string 100, e.g., by threadedly coupling the ends 120 and 122 of the tool 116 to casing string 100 subs (block 154). When the float collar tool 116 is added to the string 100, the isolation barrier 124 is in the closed state in which it blocks the internal passageway of the tool 116 and, thus, fluidly isolates the upper section 126 from the lower section 128. In the closed state, air, gas and/or other light weight fluid are trapped in the buoyant chamber 130. Heavier fluid, such as drilling mud, is then provided above the isolation barrier 124 to continue the run-in of string 100 in the wellbore 110 (block 156). In an embodiment, to prevent premature removal of the barrier 124, the rupture burst pressure of the rupture disc 127 is greater than the hydrostatic pressure of the heavier fluid during run-in of the casing string 100.

The distance that the casing string 100 is run before adding the float collar 116 depends on the configuration of the particular wellbore 110. In general, the float collar 116 is added at a location within the casing string 100 to create buoyancy so that the casing string 100 can be run in horizontal or deviated sections of the wellbore 110 without generating a drag force that is great enough to prevent the string 100 from reaching its final desired location. To that end, the float collar tool 116 is positioned at a location within the casing string 100 to assist in overcoming the drag forces on the casing string 100, thereby allowing, the casing string to be positioned at greater depths or extended to greater horizontal distances.

Once the casing string 100 has been run and landed at the final desired location in the wellbore 110, the isolation barrier 124 is transitioned to the open state in which fluid communication is provided between the upper section 126 of the passageway and the buoyant chamber 130 (block 158). In an embodiment, the barrier 124 is placed in the open state by pressuring the casing string 100 from the surface 112 (e.g., by applying fluid pressure through the casing 100) by a sufficient amount to burst the rupture disc 127. A person skilled in the art will understand that the isolation barrier 124 can be configured to have any suitable rupture pressure depending on the particular application in which the float collar tool 116 is employed.

According to an embodiment, the rupture disc 127 is a non-fragmenting type, so that it bursts but does not fragment into shards. Once the disc 127 bursts, the heavier fluid in the upper section 126 of the tool 116 mixes with the air and other low weight fluid in the buoyant chamber 130. Fluid flow through the casing string 100 following the burst may allow the trapped air and low weight fluid in the buoyant chamber 130 to rise to the surface and be vented outside the casing string 100.

Further, in the embodiment illustrated, as the heavier fluid replaces the air and the lighter fluid, the heavier fluid flows through fluid port 140 and increases the hydrostatic pressure in the piston chamber 138. Once a sufficient imbalance is achieved between the hydrostatic pressure in chamber 138 and pressure (e.g., atmospheric pressure) in the first chamber 134, the piston 136 shifts in the upward direction towards the upper end 120 of the tool 116. In other embodiments, the piston 136 can be hydraulically operated via appropriate hydraulic lines operated from the surface, as an example. In yet other embodiments, the slidable sleeve can be mechanically shifted so that it moves the barrier 124 into the protective region 144, such as by a spring or other resilient member.

In the embodiment shown in FIGS. 2 and 3, an extended end 146 of the piston 136 abuts the cylindrical wall 125 of the isolation barrier 124. When the piston 136 shifts, the piston end 146 moves the cylindrical wall 125 into the protective region 144, and a terminal end 147 of a wall 148 deflects the ruptured portions of the disc 127 so that they collapse to fit within the protective region 144 (as shown in FIG. 3). The piston 136 continues to shift until an enlarged portion 149 of the piston 136 abuts the terminal end 147 of the wall 148, thus enclosing the protective region 144 and containing the barrier 124 therein (block 160 in FIG. 4). As shown in the embodiment of FIG. 3, the enlarged portion 149 also serves to replace the void in the wall of the housing 118 left by the isolation barrier 124 so that the internal diameter of the tool 116 is substantially uniform along the length to the housing 118. As a result, the full inside diameter of the casing string assembly 100 is substantially restored with substantially no sharp edged fragments left behind by the rupture disc 127 that could later cause damage to tools run through the casing string 100.

In the embodiment shown in FIGS. 2 and 3, a locking ring system 142 is provided to lock the isolation barrier 124 within the protective region 144. In other embodiments, the locking ring system 142 can be omitted. A person skilled in the art will appreciate that various locking mechanisms can be used to maintain the isolation barrier 124 within the protective region 144.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. Descriptions of features or aspects within each embodiment should typically be considered as available for other similar features or aspects in other embodiments unless stated otherwise. The terminology used herein is for the purpose of describing the particular embodiments and is not intended to be limiting of exemplary embodiments of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the scope of the invention as defined by the following claims. Therefore, the scope of the invention is not confined by the detailed description of the invention but is defined by the following claims.

What is claimed is:

1. A tool for running a casing string in a wellbore, comprising:

a cylindrical housing having a sidewall having an inside diameter that defines a fluid passageway extending between first and second ends of the housing, the first and second ends configured to connect the housing within a casing string;

an isolation barrier disposed within the cylindrical housing and having a closed state and an open state, the isolation barrier having a cylindrical wall that is movable along the sidewall of the cylindrical housing and a barrier wall, wherein, in the closed state, the cylindrical wall is disposed at a first location along the sidewall and the barrier wall blocks the inside diameter to fluidly isolate an upper portion of the passageway from a lower portion of the passageway, and wherein, in the open state, the barrier wall allows for fluid communication through the fluid passageway; and a protective region within the cylindrical housing to contain the isolation barrier when in the open state so that the isolation barrier does not restrict the inside diameter, wherein, after the isolation barrier is placed in the open state, the cylindrical wall of the isolation barrier is moved in an axial direction from the first location along the sidewall to a second location within the protective region so that the isolation barrier is contained within the protective region.

2. The tool as recited in claim 1, further comprising a pressure-activated slidable member to move the cylindrical wall to the second location.

3. The tool as recited in claim 1, wherein the isolation barrier comprises a rupture disc.

4. The tool as recited in claim 3, wherein the rupture disc is a non-fragmenting rupture disc.

5. A method for running a casing string assembly into a wellbore, comprising:

connecting a float collar tool within a casing string assembly, the float collar tool comprising:

a cylindrical housing having a fluid passageway extending between an upper end and a lower end;

an isolation barrier having a cylindrical wall disposed at a first location along the fluid passageway and a barrier wall temporarily disposed across a diameter of the fluid passageway to create a buoyant chamber in which a light fluid is trapped in a lower portion of the casing string assembly; and a protective region formed in the cylindrical housing to store the isolation barrier after the casing string is landed at a final location in the wellbore;

providing a fluid in an upper portion of the casing string assembly that is heavier than the light fluid trapped in the lower portion of the casing string assembly;

landing the casing string assembly at the final location in the borehole;

increasing fluid pressure in the upper portion of the casing string assembly to disrupt the barrier wall of the isolation barrier and provide fluid communication between the upper and lower portions; and moving the cylindrical wall in an axial direction along the passageway from the first location to a second location within the protective region, thereby moving the disrupted barrier wall into the protective region to restore the diameter of the fluid passageway.

6. The method as recited in claim 5, wherein the isolation barrier comprises a rupture disc.

7. The method as recited in claim 6, wherein the rupture disc is a non-fragmenting rupture disc.

8. The method as recited in claim 5, wherein the float collar tool includes a piston to slide the isolation barrier into the protective region.

9. The method as recited in claim 8, wherein the increased fluid pressure activates the piston after disrupting the barrier wall.

10. The method as recited in claim 5, wherein the wellbore penetrates a hydrocarbon reservoir and includes a horizontal section.

11. The method as recited in claim 10, wherein the float collar tool is connected at a location within the casing string assembly at which the buoyant chamber reduces the horizontal weight of the casing string assembly by an amount sufficient to overcome a drag force on the casing string assembly.

12. A casing string assembly for completing a wellbore, comprising:

a lower casing string portion;

an upper casing string portion; and a float collar tool connected between the lower and upper casing string portions, the float collar tool including:

a cylindrical housing having a fluid passageway that extends between an upper end and a lower end of the housing, wherein the upper end of the housing is connected to the upper casing string portion and the lower end of the housing is connected to the lower casing string portion;

a barrier disposed within the fluid passageway during run-in of the casing string assembly in the wellbore, the barrier comprising a cylindrical wall that is moveable along the fluid passageway and a barrier wall that temporarily blocks the fluid passageway, wherein the cylindrical wall is positioned at a first location along the fluid passageway during run-in and is moved in an axial direction from the first location to a second location after landing the casing string assembly at a final location in the wellbore and opening the barrier wall to fluid flow through the fluid passageway; and a protective region formed within the cylindrical housing to store the barrier when the cylindrical wall is moved to the second location; and a buoyant chamber containing a light fluid, the buoyant chamber extending between the barrier and a fluid blocking device disposed in the lower casing string portion, wherein, during run-in of the casing string assembly in the wellbore, the barrier isolates the light fluid in the buoyant chamber from a heavier fluid in the upper casing string portion.

13. The assembly as recited in claim 12, wherein the barrier comprises a rupture disc, and wherein, after landing the casing string assembly, fluid pressure in the upper casing string portion is increased to burst the rupture disc.

14. The assembly as recited in claim 13, wherein the rupture disc is a non-fragmenting rupture disc.

15. The assembly as recited in claim 14, wherein the float collar tool further includes a pressure-activated slidable member disposed within the cylindrical housing to move the burst rupture disc into the protective region.

16. The assembly as recited in claim 15, wherein the increased fluid pressure in the upper casing portion activates the slidable member after the rupture disc is burst.

* * * * *